US005089998A

United States Patent [19]

Rund

[11] Patent Number: 5,089,998

[45] Date of Patent: Feb. 18, 1992

[54] VIBRATING AND AUDIBLE ALARM CLOCK

[76] Inventor: Richard Rund, 12A Four Winds, 4 Mt. Davis Road, Pokfulam, Hong Kong, Hong Kong

[21] Appl. No.: 680,222

[22] Filed: Apr. 4, 1991

[51] Int. Cl.[5] ..... G04B 23/02; G04B 19/06

[52] U.S. Cl. ..... 368/72; 368/230; 368/250

[58] Field of Search ..... 368/71-74, 368/230, 250, 251, 255

[56] References Cited

U.S. PATENT DOCUMENTS

| | | | |
|---|---|---|---|
| 4,637,732 | 1/1987 | Jones et al. | 368/109 |
| 4,920,525 | 4/1990 | Meister | 368/250 |
| 5,023,853 | 6/1991 | Kawata | 368/230 |

FOREIGN PATENT DOCUMENTS 2205665 12/1988 United Kingdom .

*Primary Examiner*—Vit M. Miska

*Attorney, Agent, or Firm*—Blakely, Sokoloff, Taylor & Zafman

[57] ABSTRACT

An alarm clock comprising a housing, electronic clock means including time and alarm setting means, tine indicator signal means, alarm signal generating means, and alarm off signal input means, wherein the reception of an alarm of signal disables the generation of the alarm signal, battery means connected to said electronic clock means for supplying power to said electronic clock means, a time display mounted in the face of said housing and connected to said time indicator signal means, first solid state switch means connected and responsive to said alarm signal generating means, sound generating means disposed in said housing, vibration generating means mounted to the interior of said housing, alarm mode switch means for selectively switching between alarm off and audible and vibratory alarm modes.

7 Claims, 3 Drawing Sheets

FIG. 4
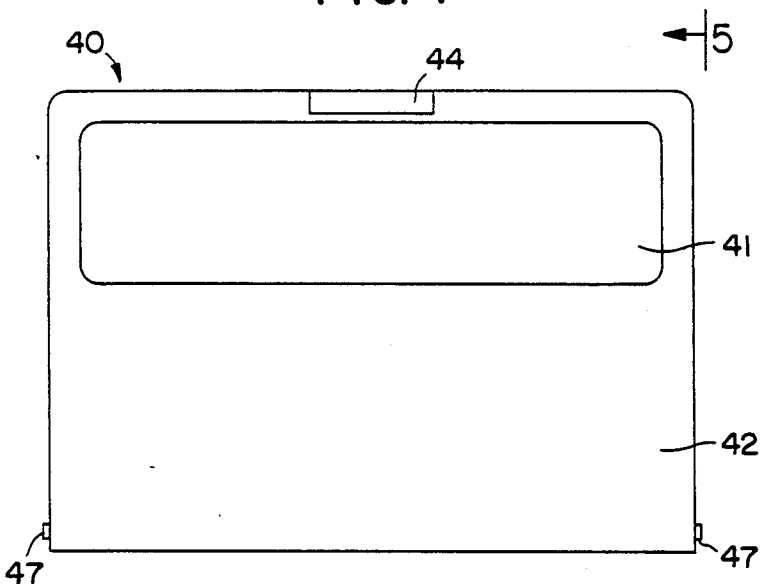
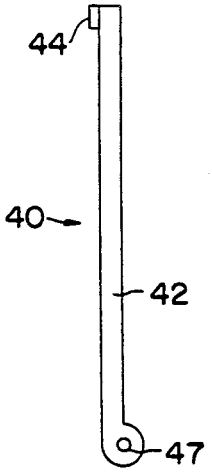
FIG. 5
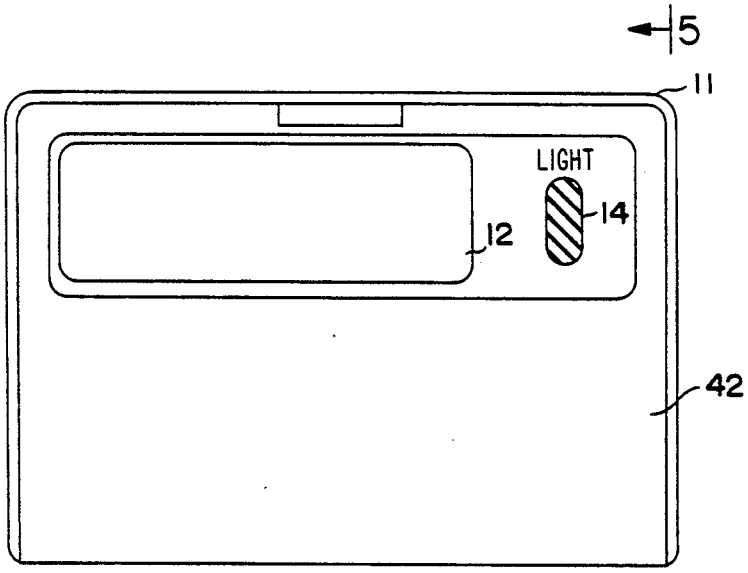
FIG. 6
FIG. 7
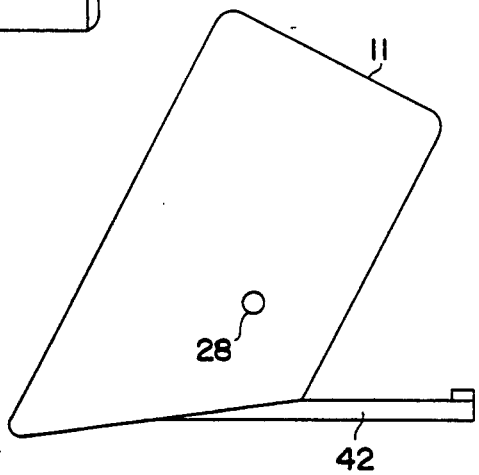

VIBRATING AND AUDIBLE ALARM CLOCK

BACKGROUND OF THE INVENTION

1. Field of the Invention

The field of the invention is alarm clocks.

2. Prior Art

The instant invention is an alarm clock having two modes of operation; namely, a virtually silent mode and an audible mode.

Alarm clocks having only an audible alarm mode are well known.

Similarly, alarm clocks having a vibratory (or silent) mode have been known for some time. An example of such a clock is described in United Kingdom Patent No. 2,205,665 issued to Michael J. Dines. The Dines Vibratory Alarm Clock is a portable electronic clock having the shape of a flattened cube with rounded corners, with its front side extending lower than the backside. The purpose of the comparatively small depth of the clock (as compared to its other dimensions) and for the front extending lower than the back is to allow for the clock to be placed under a pillow more comfortably for the user. The controls of the Dines Clock are on the face and include a 3-detent switch with a time set position, an alarm set position, and a lock position, another 3-detent switch having an alarm off position, an alarm on position, and a snooze position. The Dines Clock also has on its face hour and minute setting buttons for setting the current time and the time for the alarm to go off when the first of the above-described switches is set in the time set and alarm set positions, respectively, and a large alarm stop button to stop the alarm once alarm has started. The face of the Dines Clock also has an LCD display for visual display of the current time and the time for which the alarm is set, including an indication of whether snooze has been chosen. On the face of the clock there is a button used for turning on a light to illuminate the LCD display. The Dines Clock also has a face plate hingedly attached to the front of the clock to protect the controls on the face of the clock.

Within the housing of the Dines Clock is a generally conventional electronic clock mechanism including an alarm signal generating circuit. This electronic clock mechanism and the LCD display combine together to display time or alarm time as is well known in the art, and the clock is set according to conventional methods. The clock circuitry is powered by a 1.5 volt battery, such as the LR44 battery manufactured by Toshiba, which battery is mounted in the housing.

In the Dines Clock the alarm pulse from the clock circuit triggers the opening of a second circuit which includes a pulsing circuit and a motor. This separate circuit is powered by a separate battery power supply, typically two AA size 1.5 volt batteries such as manufactured by Eveready Battery Company, Inc. Thus, the motor is turned on in a pulsating fashion by the alarm pulse from the clock's circuitry. Where as most motors are typically mounted symmetrically to a cam in the Dines Clock the motor driveshaft is mounted eccentrically to a cam so that when the motor is operated substantial vibrations are imparted to the housing of the clock to which the motor is physically mounted.

Clocks such as the Dines Clock are particularly adapted for use by the deaf who cannot hear normal audible alarms and is also adaptable for the use when more than one person sleeping in a room and one must be woken up much earlier than the other.

The Dines Clock is also adapted for use in other environments where a normal alarm would not be heard (for example, in noisy environments) or in a situation where a normal alarm would not be appropriate. For such purposes, the clock may be clipped to the clothing of the user or may be kept in the user's pocket.

Other prior silent alarms includes the alarm clock shown in U.S. Pat. No. 4,028,882 issued to Hrand Muncheryan which features a silent alarm having a resonator unit disposed a substantial distance away from the clock and connected thereto by conventional wiring. This, of course, is not convenient for travel and provides quite a bit of awkwardness for a sleeper who might get tangled in the wiring. U.S. Pat. Nos. 4,093,944 and 4,180,810 both also issued to Muncheryan illustrate variations on the same theme.

A recently issued patent, U.S. Pat. No. 4,920,525, issued to Jack B. Meister, also features an alarm clock having a silent alarm. The Meister Clock has its clock circuitry, clock battery source, and operator panel all contained in a separate module separate from the clock's housing. The clock module of Meister includes an operator panel positioned adjacent to the display and having time setting switches mounted thereon, hinged flap for removably covering the panel while permitting viewing of the display, whereby the clock module may be in placed as a pocket watch separate from the quiet alarm.

SUMMARY OF THE INVENTION

The present invention is an alarm clock comprising a housing, electronic clock means including time and alarm setting means, time indicator signal means, alarm signal generating means, and alarm off signal input means, wherein the reception of an alarm of signal disables the generation of the alarm signal, battery means connected to said electronic clock means for supplying power to said electronic clock means, a time display mounted in the face of said housing and connected to said time indicator signal means of said electronic clock means, first solid state switch means connected and responsive to said alarm signal generating means, sound generating means disposed in said housing, vibration generating means mounted to the interior of said housing, alarm mode switch means for selectively switching between alarm off and audible and vibratory alarm modes, whereby when said alarm mode switch means is set to the alarm off mode, said alarm off signal is applied to said alarm off signal input means, said sound and vibration generating means being selectably connected to said first solid state switch means through said alarm mode switch means, said sound generating means generating an audible alarm when said sound generating means is connected to said first solid state switch means and said alarm signal generating means generates an alarm signal, and said vibration generating means generating perceptible vibrations when said vibration generating means is connected to said first solid state switch means and said alarm signal generating means generates an alarm signal.

Figure 3:
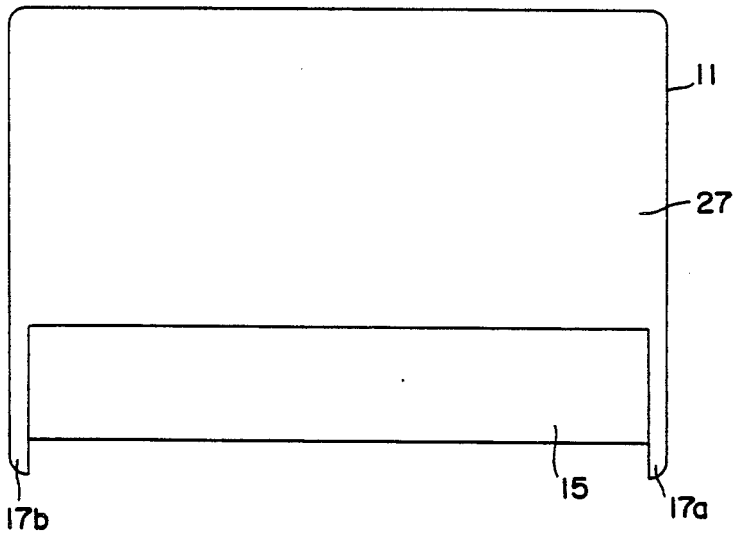

FIG. 3 is a rear view of the present invention.

FIG. 4 is a front view of the cover plate used in connection with the present invention.

FIG. 5 is a side view of the cover plate taken along lines 5—5 of FIG. 4.

FIG. 6 is a front view of the present invention with the cover plate affixed to the invention in the closed position.

FIG. 7 is a right side view of the invention with the cover plate affixed in the open position.

Figure 8:
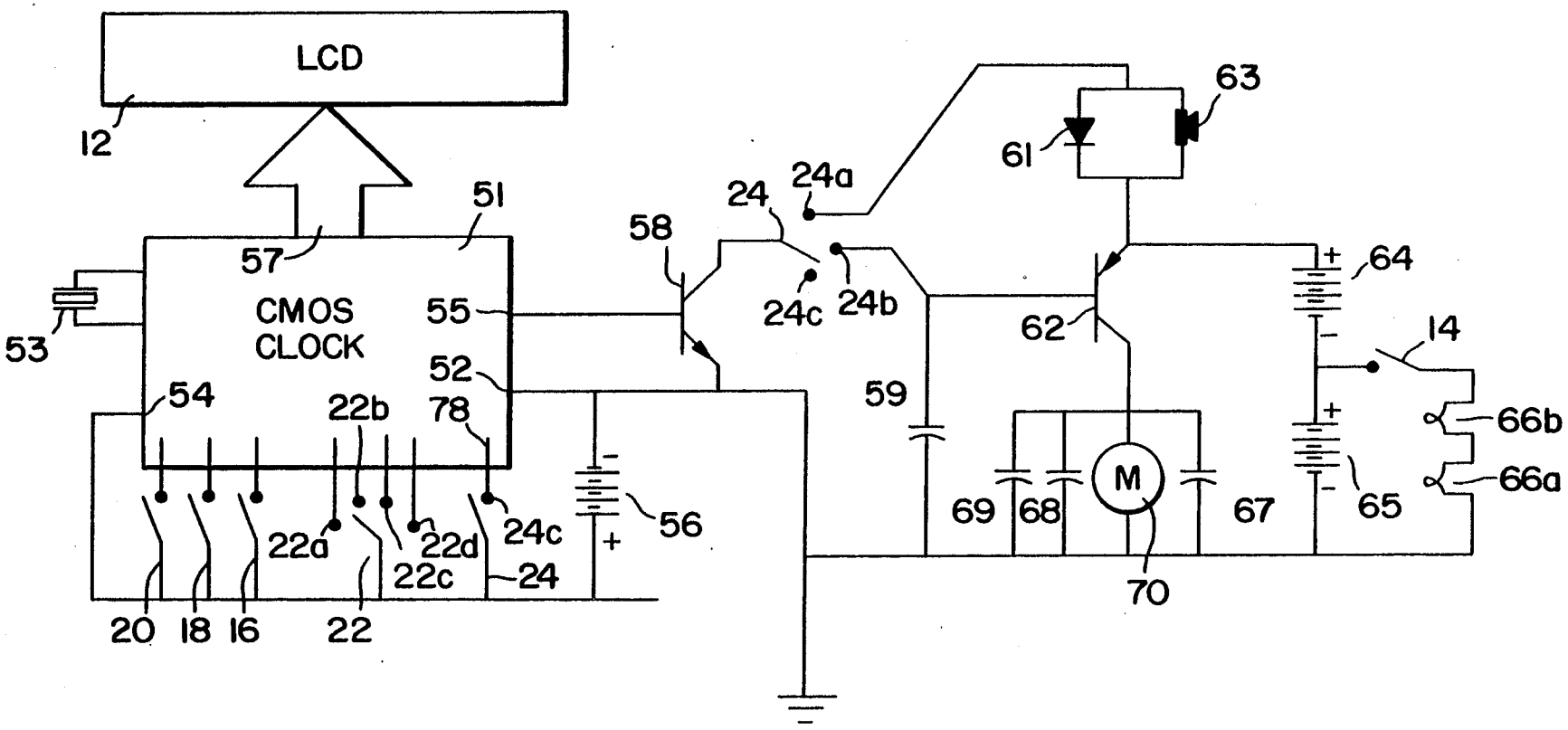

FIG. 8 is a schematic diagram of the circuitry of the present invention.

DETAILED DESCRIPTION OF THE INVENTION

The subject invention is illustrated in the attached drawings which are referred to herein. Throughout the drawings and the description below the same reference numeral will be used to identify identical elements.

Figure 1:
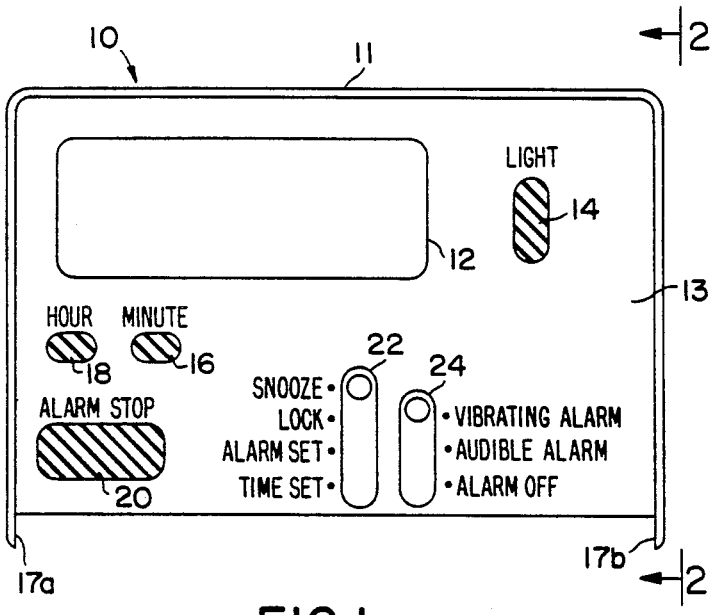
FIG. 1 is a front view of the alarm clock of the present invention.
Figure 2:
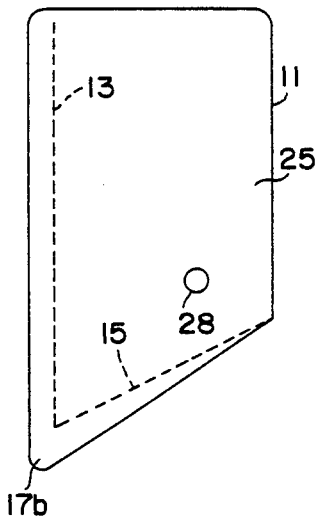
FIG. 2 is a side view of the present invention along lines 2—2 of FIG. 1. Shown in phantom lines in FIG. 2 are the recessed face and bottom surfaces of the alarm clock of the present invention.

With reference to FIGS. 1, 2 and 3, numeral 10 designates the complete assembly of the invention. The invention comprises a housing 11 formed from a rigid plastic, such as ABS plastic. In the preferred embodiment, the height (when viewed from top to bottom in FIG. 1) is about 2⅝ inches; the width (when viewed from left to right in FIG. 1) is about 3 1/16 inches; and the depth (when viewed from left to right in FIG. 2) is about 1⅛ inch. Recessed from the most forwardly disposed portion of the housing is the face 13 of the clock. Disposed in the face are push button light switch 14, push button minute setting (or count-up) switch 16, push button hour setting (or count-up) switch 18, and push button alarm stop switch 20. Also disposed in the face are a 4-detent slide switch 22 having stops for setting the time, setting the alarm, locking all time setting modes, and setting the snooze alarm, and a 3-detent slide alarm mode switch 24 with positions for arming the vibrating alarm, arming the audible alarm, and for keeping the alarms turned off. Lastly, set in the face is LCD 12 having appropriate alphanumeric displays indicating the current time, the time the alarm is set for, an indication whether the alarm is armed and whether the snooze feature has been set.

With reference to FIG. 2, the relationship between the face and the forward most edge of the housing 11 is shown. In a preferred embodiment face 13 is disposed approximately ⅛ inch from the foremost edge of the housing. Bottom surface 15 is disposed at an angle to the bottom most edge of side 25 of housing 11. The purpose of recessing the face is to prevent accidental touching of the clock's controls. The recessing of the bottom surface 15 improves the ability to grip the clock.

In addition, the recessing of face 13 and bottom surface 15 allows for easy mounting and rotation of the cover plate 40 (shown in FIGS. 4 and 5) from a closed position to protect the clock's face and to prevent accidental adjustments to the clock's controls (as shown in FIG. 6), to an open position in which the cover plate acts as a pedestal for display of the clock as shown in FIG. 7).

Disposed in side 25 is hole 28 which serves as an outlet for the sound generated by the speaker of the audible alarm.

Housing 11 is split in a conventional manner (not illustrated) to allow disassembly and reassembly of the housing to provide access to the interior of the clock housing. Similarly, the back surface 27 of the housing 11 is provided with conventional access means (not shown) for access to the battery compartments.

FIGS. 4 and 5 illustrate the cover plate which is attached to the housing of the invented alarm clock. The cover plate includes a panel 42 having a hole 41 through which the LCD display 12 may be seen and through which the light switch may be pushed. At the bottom edges of the left and right sides of the panel 42 extend projections 47 which, when the cover plate is attached to the housing, engage holes formed in extensions 17*a* and 17*b* of the housing and shown in FIGS. 1 through 3. The cover plate 40 also has a lip 44 at its top center to facilitate opening and closing of the cover plate.

FIG. 8 illustrates schematically the electronic circuitry of the present invention. With the exception of the LCD display 12, loudspeaker 63, batteries 56, 64 and 65, motor 66, capacitors 67, 68 and 69, and the user accessible control portions of switches 14, 16, 18, 20, 22, and 24, all the elements shown in FIG. 6 are mounted on a printed circuit board which is mounted, with a series of screws, into the interior of housing 11.

The circuitry of the present invention comprises a conventional electronic clock mechanism, in this case CMOS integrated clock circuit module chip 51, having terminals for connection to quartz oscillator 53, minute count-up switch 16, hour count-up switch 18, alarm stop switch 20, snooze switch 22*a*, alarm set switch 22*c*, time set switch 22*d*, and alarm off switch 24*c*. The clock circuit module also has power input terminal 54, alarm signal output terminal 55, clock display signal outputs 57 and ground terminal 52.

The clock circuit module performs in the conventional manner. Its power is received from 1.5 volt battery 56, a LR44 type battery disposed in the housing, with its positive terminal connected to input terminal 54 and its negative terminal connected to ground terminal 52. The clock circuit module keeps time by counting the oscillations of oscillator 53. The actual time may be set when a time set enable signal is being received through switch terminal 22*d*. Repeated closures of switches 16 and 18 by the user, when the time set enable signal is received (i.e., when switch 22 is set to terminal 22*d*), cause the clock circuit module to count minutes and hours, respectively, upward until the actual time (or running time) is set. The time that the clock should provide an alarm signal may be set by similar closures of switches 16 and 18 when the alarm set enable signal is being received when switch 22 is set to 22*c*.

While the alarm set enable signal is received, the alarm time (or the alarm time being set) is displayed on LCD 12 by virtue of signals transmitted through outputs 57. When the time set enable signal is received the time being set is displayed on LCD 12. At all other times, the running time is displayed on the LCD.

When switch 22 is set to 22*b* (the lock position), or when it is set to 22*a* (the "snooze") position, closures of switches 16 and 18 have no effect on the clock circuit.

Provided that switch 24 is not set to the alarm off position (22*c*), when the running time matches the alarm time an alarm signal is transmitted through output terminal 55 for approximately one minute, or until alarm stop switch 20 is closed, causing the alarm signal to be interrupted until the running time matches the alarm time again. If switch 22 is set to the snooze position (22*a*), once the running time matches the alarm time the alarm signal will be transmitted for one minute periods every three minutes until switch 22 is set to the lock position or switch 24 is set to the alarm off position.

When switch 22 is in the snooze position, a "snooze" icon display signal is transmitted through output terminals 57 to LCD 12 on which the snooze icon is displayed. Similarly, an "alarm on" icon is displayed whenever switch 24 is in any position besides the alarm off position (24*c*). When switch 24 is in the alarm off position a signal is input into terminal 75 of the clock circuit module and the alarm signal is disabled.

In all these respects the clock circuit module 51 and LCD 12 operate in a conventional manner.

The clock of the present invention differs from conventional alarm clocks in the manner in which it combines audible and vibratory (i.e., virtually silent) means for communicating the alarm to the user.

Alarm signal output terminal 55 of clock circuit module 51 is connected to the base of npn transistor 58 (manufacturer's code no. L7), the emitter of which is connected to ground. Transistor 58's collector is connected to alarm mode switch 24, which, as discussed above, has three positions. Positions 24*a* and 24*b* connect transistor 58 to either the audible or vibratory alarm means.

When switch 24 is set to the alarm off position (24*c*) the collector of transistor 58 is disconnected from the two alarm means, and at the same time a connection is made from the positive terminal of battery 56 to alarm mode input terminal 75 of the clock circuit module, and no alarm signal is sent to the base of transistor 58. In such event, transistor 58 remains off and neither the audible or vibratory alarm is activated.

Switch connector 24*a* is connected to the anode of diode 61 and one side of speaker 63. Speaker 63 is mounted on the interior of housing side 25 adjacent hole 28. The cathode of diode 61 and the other side of speaker 63 are connected to the high side of batteries 64 and 65, which are two 1.5 volt AA batteries connected in series, with the negative side connected to ground. (Diode 61 serves to block inductive kick, and resulting damage to the other circuit elements, if switch 24 is moved from 24*a* to some other position during operation of the speaker.)

Switch connector 24*b* is connected to the base of pnp transistor 62 (manufacturer's code no. 8550) and to one side of capacitor 59 (100 $\mu$F in the preferred embodiment). The other side of capacitor 59 is connected to ground. (Capacitor 59 prevents transistor 62 from being turned on by noise.) The emitter of transistor 62 is connected to the high side of batteries 64 and 65, and the collector is connected to one terminal of dc motor 70. The other side of motor 70 is connected to ground. Dc motor 70 is mounted along the interior of bottom 15 of the housing. Across the terminals of motor 70 are three capacitors connected in parallel, capacitors 67, 68 and 69 respectively having values of 47 $\mu$F, 47 $\mu$F, and 0.047 $\mu$F, respectively.

When switch 24 is set in the audible alarm position (24*a*), transistor 62 is turned off and the vibratory alarm mode is disabled. However, the audible alarm mode is enabled and when the alarm signal is output from terminal 55, transistor 58 is turned on and loudspeaker 63 will be caused to sound as long as the alarm signal is present. And of course, a hearing user will hear the alarm. The speaker may be a ceramic speaker, a piezo beeper or a coil speaker.

When switch 24 is set in the vibratory alarm position (24*b*), the speaker circuit is open and the audible alarm mode is disabled. The motor circuit is completed, however, and if the alarm signal is output from terminal 55, transistors 58 and 59 are turned on and motor 70 runs.

Motor 70 has a weighted cam mounted eccentrically to the motor's drive shaft so that when the motor is running, it causes substantial vibrations to be imparted to the housing 11.

These vibrations can catch the attention of a sleeping user who has the clock place under the user's pillow. This is helpful to not only the hearing impaired; it is helpful to the hearing enabled who must be awakened without disturbing others who share the same room. The clock of the present invention has other uses of course. For example, if the clock is slipped into a user's pocket, the user may, at the user's choice, be silently or audibly reminded of an important time of day. A user needing to be reminded of a certain time while attending a lecture or a meeting may set the alarm for vibratory alarm mode and have the alarm go on without disturbing others.

The circuitry of FIG. 8 helps subdue noise signals which when the alarm modes are used tend to interfere with the accuracy of the clock circuit module.

The invention is also provided with, as shown in FIG. 8, two small light bulbs connected in series from ground to one side of switch 14, the other side of which is connected to the positive terminal of battery 65. The bulbs are mounted on the printed circuit board so that they are positioned on either side of LCD 12. When switch 14 is closed by the user the LCD is illuminated so that it may be read in the dark.

Above there has been described a vibratory and audible alarm clock. It will be understood that various other changes of the details, materials, steps, arrangements of parts, and uses, which have been herein described and illustrated in order to explain the nature of the invention, will occur to and may be made by those skilled in the art, upon a reading of this disclosure, and such changes are intended to be included within the principles and scope of this invention.

I claim:

1. An alarm clock comprising:

a substantially flat, rectangular housing;

electronic clock means disposed in said housing, said electronic clock means including time and alarm setting means, time indicator signal means, alarm signal generating means, and alarm off signal input means, wherein the reception of an alarm off signal disables the generation of the alarm signal;

first battery means disposed in said housing and connected to said electronic clock means for supplying power to said electronic clock means;

a time display mounted in the face of said housing and connected to said time indicator signal means of said electronic clock means;

first solid state switch means disposed in said housing, said first solid state means being connected and responsive to said alarm signal generating means;

sound generating means disposed in said housing;

vibration generating means mounted to the interior of said housing;

alarm mode switch means for selectively switching between alarm off and audible and vibratory alarm modes, said alarm mode switch means mounted in said housing and having user accessible means, said alarm mode switch means being connected to said first solid state switch means, said sound generating means, said vibration generating means and said alarm off signal input means, whereby when said alarm mode switch means is set to the alarm off mode, said alarm off signal is applied to said alarm off signal input means;

said sound generating means being selectably connected to said first solid state switch means through said alarm mode switch means, said sound generating means generating an audible alarm when said sound generating means is connected to said first solid state switch means and said alarm signal generating means generates an alarm signal; and said vibration generating means being selectably connected to said first solid state switch means through said alarm mode switch means, said vibration generating means generating perceptible vibrations when said vibration generating means is connected to said first solid state switch means and said alarm signal generating means generates an alarm signal.

2. The alarm clock of claim 1 further comprising second battery means disposed in said housing and connected to said sound generating means and said vibration generating means for supplying power to said sound generating means and said vibration generating means, wherein said first battery means does not provide power for said sound generating means and said vibration generating means.

3. The alarm clock of claim 2 wherein said vibration generating means comprises a dc motor with a weight eccentrically disposed on its drive shaft.

4. The alarm clock of claim 3 wherein said vibration generating means further comprises capacitive means disposed across said dc motor's terminals.

5. The alarm clock of claim 4 further comprising second solid state switch means disposed in said housing, said second solid state switch means being connected between said vibration generating means and said first solid state switch means through alarm mode switch means, whereby said vibration generating means is responsive to said alarm signal when said alarm mode switch means is set to selectively connect said second solid state switch means to said first solid state switch means.

6. The alarm clock of claim 5 wherein said first solid state switch means is a npn transistor with its base connected to said alarm signal generating means, its collector connected to said alarm mode switch means, and its emitter connected to ground.

7. The alarm clock of claim 6 wherein said second solid state switch means is a pnp transistor with its base connected to said alarm mode switch means, its emitter connected to the positive side of said second battery means and its collector connected to one terminal of said dc motor, with the negative side of said second battery means and the other terminal of said dc motor being connected to ground.

* * * * *